US011085265B2

(12) United States Patent
Rivas Diaz

(10) Patent No.: US 11,085,265 B2
(45) Date of Patent: Aug. 10, 2021

(54) DOWNHOLE SEALING TOOL

(71) Applicant: SCHLUMBERGER TECHNOLOGY CORPORATION, Sugar Land, TX (US)

(72) Inventor: Oscar Rivas Diaz, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 213 days.

(21) Appl. No.: 15/514,030

(22) PCT Filed: Sep. 25, 2015

(86) PCT No.: PCT/US2015/052167
§ 371 (c)(1),
(2) Date: Mar. 24, 2017

(87) PCT Pub. No.: WO2016/049424
PCT Pub. Date: Mar. 31, 2016

(65) Prior Publication Data

US 2017/0247971 A1 Aug. 31, 2017

Related U.S. Application Data

(60) Provisional application No. 62/055,149, filed on Sep. 25, 2014, provisional application No. 62/055,166, (Continued)

(51) Int. Cl.
*H01R 13/523* (2006.01)
*E21B 33/038* (2006.01)
(Continued)

(52) U.S. Cl.
CPC ..... *E21B 33/0385* (2013.01); *E21B 23/00* (2013.01); *E21B 29/02* (2013.01);
(Continued)

(58) Field of Classification Search
CPC ..... E21B 43/105; E21B 33/13; E21B 33/12; E21B 33/36
See application file for complete search history.

(56) References Cited

U.S. PATENT DOCUMENTS 5,279,787 A * 1/1994 Oltrogge ..... B22F 9/08 164/900
8,151,895 B1 4/2012 Kunz
(Continued)

FOREIGN PATENT DOCUMENTS

WO 2011151271 A1 12/2011

OTHER PUBLICATIONS

International Search Report and Written Opinion issued in International Patent Appl. No. PCT/US2015/052167 dated Jan. 4, 2016; 23 pages.

*Primary Examiner* — Waseem Moorad
*Assistant Examiner* — Theodore N Yao
(74) *Attorney, Agent, or Firm* — Michael L. Flynn; Cathy Hewitt

(57) ABSTRACT

A sealing tool for conveyance within a tubular member within a wellbore extending into a subterranean formation. The sealing tool includes a mandrel and a eutectic sealing material disposed about the mandrel. The eutectic sealing material has a eutectic temperature at which the eutectic sealing material melts. The sealing tool also includes means for heating the eutectic sealing material to at least the eutectic temperature. The eutectic sealing material is transferred onto an inner surface of the tubular member by activating the heating means to heat the eutectic sealing material to at least the eutectic temperature to melt the eutectic sealing material.

29 Claims, 4 Drawing Sheets

Related U.S. Application Data filed on Sep. 25, 2014, provisional application No. 62/055,180, filed on Sep. 25, 2014.

(51) Int. Cl.

| | |
|---|---|
| ***E21B 23/00*** | (2006.01) |
| ***E21B 29/02*** | (2006.01) |
| ***E21B 29/10*** | (2006.01) |
| ***E21B 33/138*** | (2006.01) |
| ***E21B 33/14*** | (2006.01) |
| ***E21B 36/00*** | (2006.01) |
| ***E21B 17/20*** | (2006.01) |
| ***E21B 29/00*** | (2006.01) |
| ***E21B 33/02*** | (2006.01) |
| ***E21B 33/12*** | (2006.01) |
| ***E21B 33/13*** | (2006.01) |
| ***E21B 41/00*** | (2006.01) |

(52) U.S. Cl.

CPC ..... *E21B 29/10* (2013.01); *E21B 33/138* (2013.01); *E21B 33/143* (2013.01); *E21B 36/00* (2013.01); *E21B 17/20* (2013.01); *E21B 29/002* (2013.01); *E21B 33/02* (2013.01); *E21B 33/12* (2013.01); *E21B 33/13* (2013.01); *E21B 41/00* (2013.01); *H01R 13/523* (2013.01)

(56) References Cited

U.S. PATENT DOCUMENTS

| | | | | |
|---|---|---|---|---|
| 2002/0056553 | A1* | 5/2002 | Duhon | E21B 36/04 166/302 |
| 2002/0158064 | A1 | 10/2002 | Spencer | |
| 2004/0149418 | A1* | 8/2004 | Bosma | E21B 29/10 164/98 |
| 2006/0037750 | A1 | 2/2006 | Wardlaw | |
| 2012/0298359 | A1* | 11/2012 | Eden | E21B 33/1204 166/288 |
| 2013/0087335 | A1* | 4/2013 | Carragher | E21B 23/00 166/288 |
| 2013/0199786 | A1* | 8/2013 | McConaghy | E21B 43/121 166/302 |
| 2015/0064591 | A1* | 3/2015 | Haltiner, Jr. | E21B 43/2401 429/435 |

* cited by examiner

DOWNHOLE SEALING TOOL

CROSS-REFERENCE TO RELATED APPLICATIONS

This application claims priority to and the benefit of the following, the entire disclosures of which are hereby incorporated herein by reference: U.S. Provisional Application No. 62/055,166, titled "DOWNHOLE EUTECTIC MATERIAL PATCH," filed Sep. 25, 2014; U.S. Provisional Application No. 62/055,149, titled "DOWNHOLE EUTECTIC MATERIAL HEATING ASSEMBLY AND METHOD," filed Sep. 25, 2014; and U.S. Provisional Application No. 62/055,180, titled "DOWNHOLE EUTECTIC MATERIAL PATCH WITH ANCHOR," filed Sep. 25, 2014.

BACKGROUND OF THE DISCLOSURE

The present disclosure is related in general to wellsite equipment, such as oilfield surface equipment, downhole assemblies, coiled tubing (CT) assemblies, slickline assemblies, and the like. The present disclosure is also related to the use of downhole sealing materials.

Coiled tubing is a technology that has been expanding its range of application since its introduction to the oil industry in the 1960's. Its ability to pass through completion tubulars and the wide array of tools and technologies that may be used in conjunction with it make coiled tubing a versatile technology. Typical coiled tubing apparatus include surface pumping facilities, a coiled tubing string mounted on a reel, a method to convey the coiled tubing into and out of the wellbore (such as an injector head or the like), and surface control apparatus at the wellhead. Coiled tubing has been utilized for performing well treatment and/or well intervention operations in existing wellbores, such as, but not limited to, hydraulic fracturing, matrix acidizing, milling, perforating, coiled tubing drilling, and the like.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a sealing tool for conveyance within a tubular member within a wellbore extending into a subterranean formation. The sealing tool includes a mandrel and a eutectic sealing material disposed about the mandrel. The eutectic sealing material has a eutectic temperature at which the eutectic sealing material melts. The sealing tool also includes means for heating the eutectic sealing material to at least the eutectic temperature.

The present disclosure also introduces a method that includes conveying a sealing tool within a tubular member within a wellbore extending into a subterranean formation. The sealing tool includes a mandrel, a eutectic sealing material disposed about the mandrel, and means for heating the eutectic sealing material. The eutectic sealing material is transferred onto an inner surface of the tubular member by activating the heating means to heat the eutectic sealing material to at least the eutectic temperature to melt the eutectic sealing material.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
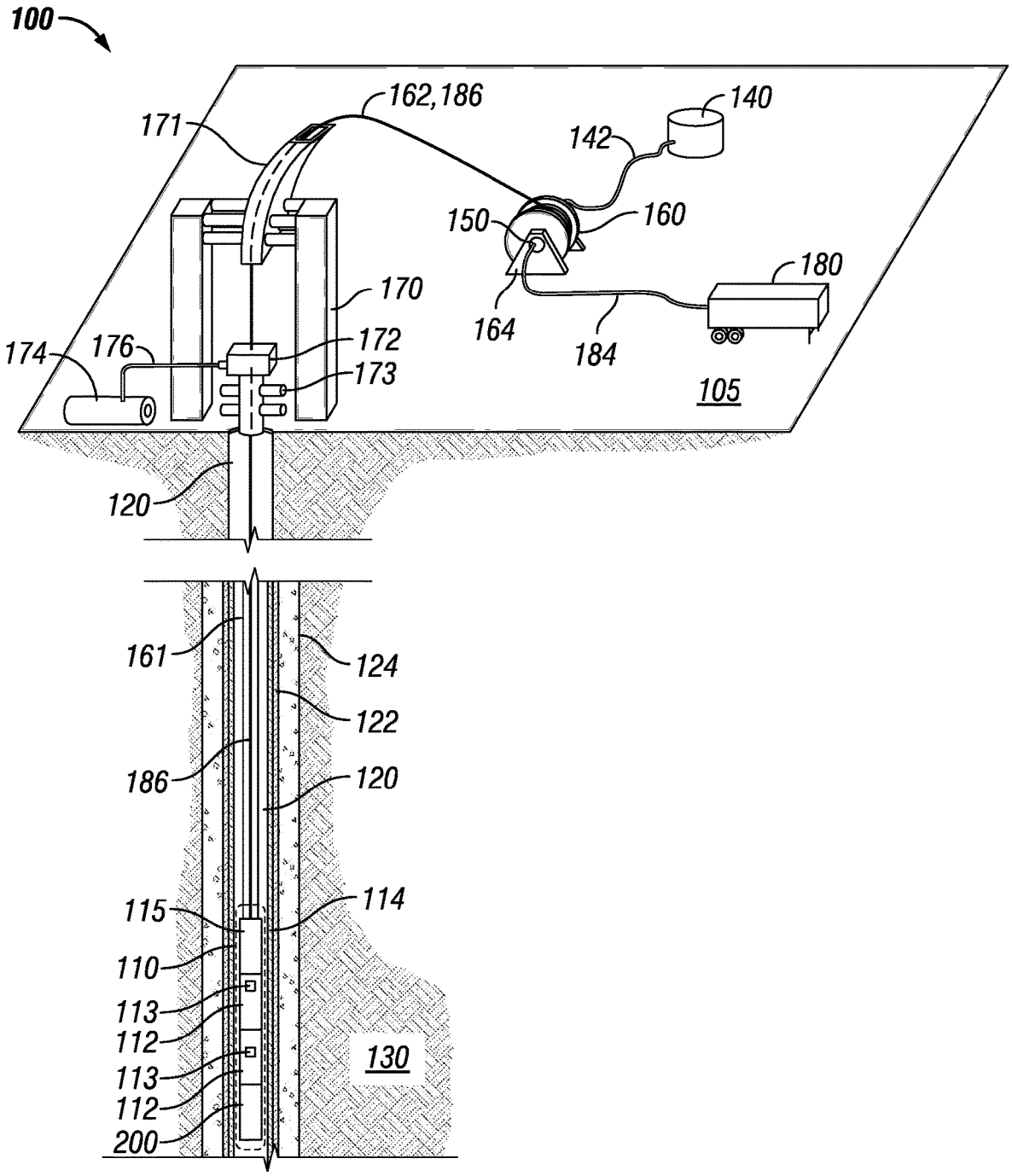
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example wellsite system 100 according to one or more aspects of the present disclosure, representing an example coiled tubing environment in which one or more apparatus described herein may be implemented, including to perform one or more methods and/or processes also described herein. However, it is to be understood that aspects of the present disclosure are also applicable to implementations in which wireline, slickline, and/or other conveyance means are utilized instead of or in addition to coiled tubing.

FIG. 1 depicts a wellsite surface 105 upon which various wellsite equipment is disposed proximate a wellbore 120. FIG. 1 also depicts a sectional view of the Earth below the wellsite surface 105 containing the wellbore 120, as well as a tool string 110 positioned within the wellbore 120. The wellbore 120 extends from the wellsite surface 105 into one or more subterranean formations 130. When utilized in cased-hole implementations, a cement sheath 124 may secure a casing 122 within the wellbore 120. However, one or more aspects of the present disclosure are also applicable to open-hole implementations, in which the cement sheath 124 and the casing 122 have not yet been installed in the wellbore 120.

At the wellsite surface 105, the wellsite system 100 may comprise a control center 180 comprising processing and communication equipment operable to send, receive, and process electrical and/or optical signals. The control center 180 is operable to control at least some aspects of operations of the wellsite system 100.

The control center 180 may comprise an electrical power source operable to supply electrical power to components of the wellsite system 100, including the tool string 110. The electrical signals, the optical signals, and the electrical power may be transmitted between the control center 180 and the tool string 110 via conduits 184, 186 extending between the control center 180 and the tool string 110. The conduits 184, 186 may each comprise one or more electrical conductors, such as electrical wires, lines, or cables, which may transmit electrical power and/or electrical control signals from the control center 180 to the tool string 110, as well as electrical sensor, feedback, and/or other data signals from the tool string 110 to the control center 180. The conduits 184, 186 may each further comprise one or more optical conductors, such as fiber optic cables, which may transmit light pulses and/or other optical signals (hereafter collectively referred to as optical signals) between the control center 180 and the tool string 110.

The conduits 184, 186 may collectively comprise a plurality of conduits or conduit portions interconnected in series and/or in parallel and extending between the control center 180 and the tool string 110. For example, as depicted in the example implementation of FIG. 1, the conduit 184 extends between the control center 180 and a reel 160 of coiled tubing 162, such that the conduit 184 may remain substantially stationary with respect to the wellsite surface 105. The conduit 186 extends between the reel 160 and the tool string 110 via the coiled tubing 162, including the coiled tubing 162 spooled on the reel 160. Thus, the conduit 186 may rotate and otherwise move with respect to the wellsite surface 105. The reel 160 may be rotatably supported on the wellsite surface 105 by a stationary base 164, such that the reel 160 may be rotated to advance and retract the coiled tubing 162 within the wellbore 120. The conduit 186 may be contained within an internal passage of the coiled tubing 162, secured externally to the coiled tubing 162, or embedded within the structure of the coiled tubing 162. A rotary joint 150, such as may be known in the art as a collector, provides an interface between the stationary conduit 184 and the moving conduit 186.

The wellsite system 100 may further comprise a fluid source 140 from which fluid may be conveyed by a fluid conduit 142 to the reel 160 of coiled tubing 162. The fluid conduit 142 may be fluidly connected to the coiled tubing 162 by a swivel or other rotating coupling (obstructed from view in FIG. 1). The coiled tubing 162 may be utilized to convey the fluid received from the fluid source 140 to the tool string 110 coupled at the downhole end of the coiled tubing 162 within the wellbore 120.

The wellsite system 100 may further comprise a support structure 170, such as may include or otherwise support a coiled tubing injector 171 and/or other apparatus operable to facilitate movement of the coiled tubing 162 in the wellbore 120. Other support structures may be also included, such as a derrick, a crane, a mast, a tripod, and/or other structures. A diverter 172, a blow-out preventer (BOP) 173, and/or a fluid handling system 174 may also be included as part of the wellsite system 100. For example, during deployment, the coiled tubing 162 may be passed from the injector 171, through the diverter 172 and the BOP 173, and into the wellbore 120. The tool string 110 may be conveyed along the wellbore 120 via the coiled tubing 162 in conjunction with the coiled tubing injector 171, such as may be operable to apply an adjustable uphole and downhole force to the coiled tubing 162 to advance and retract the tool string 110 within the wellbore 120.

During some downhole operations, fluid may be conveyed through the coiled tubing 162 and may exit into the wellbore 120 adjacent to the tool string 110. For example, the fluid may be directed into an annular area between the sidewall of the wellbore 120 and the tool string 110 through one or more ports (not shown) in the coiled tubing 162 and/or the tool string 110. Thereafter, the fluid may flow in the uphole direction and out of the wellbore 120. The diverter 172 may direct the returning fluid to the fluid handling system 174 through one or more conduits 176. The fluid handling system 174 may be operable to clean the fluid and/or prevent the fluid from escaping into the environment. The fluid may then be returned to the fluid source 140 or otherwise contained for later use, treatment, and/or disposal.

The tool string 110 may be a single or multiple modules, sensors, and/or tools 112, hereafter collectively referred to as the tools 112. For example, the tool string 110 and/or one or more of the tools 112 may be or comprise at least a portion of a monitoring tool, an acoustic tool, a density tool, a drilling tool, an electromagnetic (EM) tool, a formation testing tool, a fluid sampling tool, a formation logging tool, a formation measurement tool, a gravity tool, a magnetic resonance tool, a neutron tool, a nuclear tool, a photoelectric factor tool, a porosity tool, a reservoir characterization tool, a resistivity tool, a seismic tool, a surveying tool, and/or a tough logging condition (TLC) tool, among other examples within the scope of the present disclosure.

One or more of the tools 112 may be or comprise a casing collar locator (CCL) operable to detect ends of casing collars by sensing a magnetic irregularity caused by the relatively high mass of an end of a collar of the casing 122. One or more of the tools 112 may also or instead be or comprise a gamma ray (GR) tool that may be utilized for depth correlation. The CCL and/or GR tools may transmit signals in real-time to wellsite surface equipment, such as the control center 180, via the conduits 184, 186. The CCL and/or GR tool signals may be utilized to determine the position of the tool string 110, such as with respect to known casing collar numbers and/or positions within the wellbore 120. Therefore, the CCL and/or GR tools may be utilized to detect and/or log the location of the tool string 110 within the wellbore 120, such as during intervention operations as described below.

One or more of the tools 112 may also comprise one or more sensors 113. The sensors 113 may include inclination and/or other orientation sensors, such as accelerometers, magnetometers, gyroscopic sensors, and/or other sensors for utilization in determining the orientation of the tool string 110 relative to the wellbore 120. The sensors 113 may also or instead include sensors for utilization in determining petrophysical and/or geophysical parameters of a portion of the formation 130 along the wellbore 120, such as for measuring and/or detecting one or more of pressure, temperature, strain, composition, and/or electrical resistivity, among other examples within the scope of the present disclosure. The sensors 113 may also or instead include fluid sensors for utilization in detecting the presence of fluid, a certain fluid, or a type of fluid within the tool string 110 or the wellbore 120. The sensors 113 may also or instead include fluid sensors for utilization in measuring properties and/or determining composition of fluid sampled from the wellbore 120 and/or the formation 130, such as spectrometers, fluorescence sensors, optical fluid analyzers, density sensors, viscosity sensors, pressure sensors, and/or temperature sensors, among other examples within the scope of the present disclosure.

One or more of the tools 112 may also be or comprise perforating guns and/or other perforating tools. For example, such a perforating tool may be positioned in the tool string 110 uphole of the sealing tool 200 described below, such as in implementations in which the sealing tool 200 may be utilized to plug and abandon a lower zone of the wellbore 120, the sealing tool 200 may be then be disconnected from the tool string 110, and then the perforating tool may be utilized to perforate a new zone above the abandoned zone, and such sequence of operations could be performed without removing the tool string 110 from the wellbore 120.

The wellsite system 100 may also include a telemetry system comprising one or more downhole telemetry tools 115 (such as may be implemented as one or more of the tools 112) and/or a portion of the control center 180 to facilitate communication between the tool string 110 and the control center 180. The telemetry system may be a wired electrical telemetry system and/or an optical telemetry system, among other examples.

One of the tools 112, designated in FIG. 1 by reference number 200, is a sealing tool operable to seal and/or repair a tubular member downhole, such as the casing 122 and/or a portion of completion/production tubular member 114. For example, the sealing tool 200 may be operable to smooth out, patch, plug, or otherwise repair holes, perforations, scrapes, deformations, and other damaged portions of the tubular member.

Figure 2:
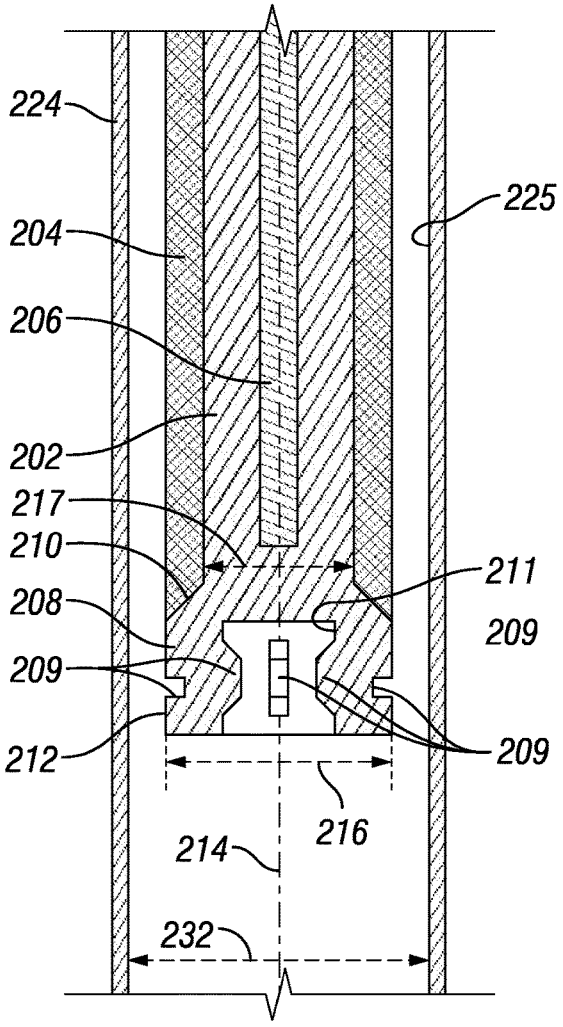
FIGS. 2 and 3 are schematic sectional views of a portion of an example implementation of the apparatus shown in FIG. 1 at different stages of operation.
Figure 3:
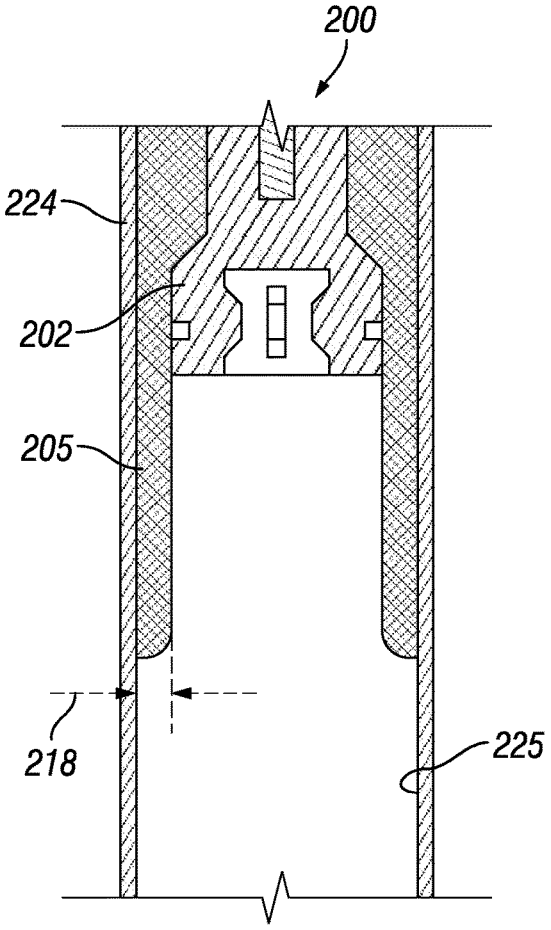

FIGS. 2 and 3 are schematic sectional views of at least a portion of an example implementation of the sealing tool 200 shown in FIG. 1. The following description refers to FIGS. 1-3, collectively.

The sealing tool 200 comprises a mandrel 202 directly or indirectly coupled to another portion of the tool string 110, such as an adjacent other one of the tools 112 of the tool string 110. The sealing tool 200 also carries or otherwise comprises a eutectic sealing material 204 disposed about the mandrel 202. The eutectic sealing material 204 is disposed about the mandrel 202 in a manner permitting the eutectic sealing material 204 to remain about the mandrel 202 during downhole conveyance operations. For example, the eutectic sealing material 204 may be provided in the form of one or more rings (not shown) that are stacked or otherwise disposed about the mandrel 202, although other arrangements are also within the scope of the present disclosure. The eutectic sealing material 204 may be selected based on, for example, anticipated wellbore conditions and a well intervention operation to be performed with the sealing tool 200.

The eutectic sealing material 204 is an alloy or other combination of elements, compounds, and/or other constituents formulated such that the melting point of the eutectic sealing material 204 is lower than the melting points of each of the individual constituents. The melting temperature of the eutectic sealing material 204 is known as the eutectic temperature. On a phase diagram (not shown), the intersection of the eutectic temperature and the eutectic composition gives the eutectic point. The eutectic temperature depends on the amounts and perhaps relative orientations of its constituents. The eutectic sealing material 204 may comprise a bismuth-based alloy, such as may substantially comprise 58% bismuth and 42% tin, by weight. However, other eutectic alloys are also within the scope of the present disclosure.

After positioning the sealing tool 200 relative to the casing 122, the completion/production tubular member 114, and/or other tubular member that is the subject of the intervention operation, which is generally designated in FIGS. 2 and 3 by reference numeral 224, the eutectic sealing material 204 is transformed into a eutectic state by heating via electrical, chemical, and/or other heating means 206. The eutectic sealing material 204 then melts, transforming from a solid state to a liquid or melted state. When in the melted state, the eutectic sealing material 204 may be molded or otherwise formed to perform the well intervention operation.

The heating means 206 may comprise one or more electrical heating coils or other elements (not shown) disposed within the mandrel 202 substantially along the length of the eutectic sealing material 204. Electric power may be provided to the heating means 206 via one or more electrical conductors of the conduits 184, 186. The tool string 100 may also comprise an internal alternator or generator (not shown) for generating heat or electrical energy to heat the eutectic sealing material 204.

The heating means 206 may also or instead comprise one or more thermites and/or other heat-generating chemical elements, such as may be disposed in solid or powder form substantially along the length of the eutectic sealing material 204, whether within the mandrel 202 or between the mandrel 202 and the eutectic sealing material 204. The heat-generating chemical elements may be activated to generate heat via chemical reaction, thus melting the eutectic sealing material 204 about the mandrel 202.

A downhole portion 208 of the mandrel 202 at or near the downhole end of the mandrel 202 has a larger outer diameter 216 relative to the diameter 217 of the rest of the mandrel 202. The transition between the diameters 216, 217 defines a spreader 210 that urges the melted eutectic sealing material 204 radially outward toward the tubular member 224, such as to provide a path for a subsequent downhole tool or fluid placement within the wellbore 20. The spreader 210 extends circumferentially around the mandrel 202, and tapers diagonally with respect to a longitudinal axis 214 of the sealing tool 200, such as to form a substantially frustoconical surface.

For example, as depicted in FIG. 3, after the heating means 206 is activated, the melted eutectic sealing material 204 may flow in a downhole direction and be urged onto the inner surface 225 of the tubular member 225. The mandrel 202 may also be pulled in the uphole direction with respect to the tubular member 224 by the coiled tubing 162 and/or other conveyance means, such that the spreader 210 may further urge the melted eutectic sealing material 204 onto the inner surface 225 of the tubular member 224. As the melted eutectic sealing material 204 is squeezed between the downhole portion 208 of the mandrel 202 and the tubular member 224, the downhole portion 208 contacts and absorbs heat from the melted eutectic sealing material 204. Consequently, the eutectic sealing material 204 cools and solidifies, thus conformingly adhering to the inner surface 225 of the tubular member 224 without further flowing along the tubular member 224 or otherwise deforming from the shape formed by the spreader 210. Accordingly, a layer 205 of eutectic sealing material 204 is formed along the inner surface 225 of the tubular member 224. The layer 205 may form a patch for a damaged portion of the tubular member 224, and/or may provide a new or repaired inner surface of the tubular member 224, such as may permit subsequent downhole tool or fluid placement within the tubular member 224.

The mandrel 102 may be moved in the uphole direction at a speed that permits the melted eutectic sealing material 204 to cool to a temperature at which the viscosity and/or other properties of the eutectic sealing material 204 reach an intended level of solidity. The properties of the eutectic sealing material 104 may be selected such that the eutectic sealing material 204 chemically and/or otherwise bonds with the inner surface 225 of the tubular member 224 and/or otherwise permits the eutectic sealing material 204 to be molded and/or otherwise shaped by the spreader 210.

The diameter 216 of the downhole portion 208 of the mandrel 202 may be slightly smaller than the inner diameter 232 of the tubular member 224. For example, the outer diameter 216 may be selected based on the inner diameter 232 and an intended thickness of the layer 205 of eutectic sealing material 204 to be applied to the inner surface 225 of the tubular member 224.

The spreader 210 may also comprise one or more a flexible scoopers, bristles, and/or other filaments (not shown) operable to distribute the melted eutectic sealing material 204 around the inner surface 225 of the tubular member 224. Although shown as being integral to the downhole portion 208 of the mandrel 202, the spreader 210 may be a separate and distinct portion of the sealing tool 200 connected to the mandrel 202.

The downhole portion 208 of the mandrel 202 may be substantially solid or, as shown in FIGS. 2 and 3, may comprise recesses, holes, fins, and/or other heat-dissipating features 209 extending into or from the outer surface 212 of the downhole portion 208 and/or a cavity 211 extending into the downhole end of the mandrel 202. Such features 209 may aid in absorbing heat from the melted eutectic sealing material 204 and/or in transferring heat from the melted eutectic sealing material 204 to the surrounding environment, which may include water and/or other fluids within the tubular member 224.

The thickness 218 of the layer 205 of eutectic sealing material formed on the inner surface 225 of the tubular member 224 may range between about 5 millimeters (mm) and about 25 mm. However, the thickness 218 may have other values within the scope of the present disclosure.

Figure 4:
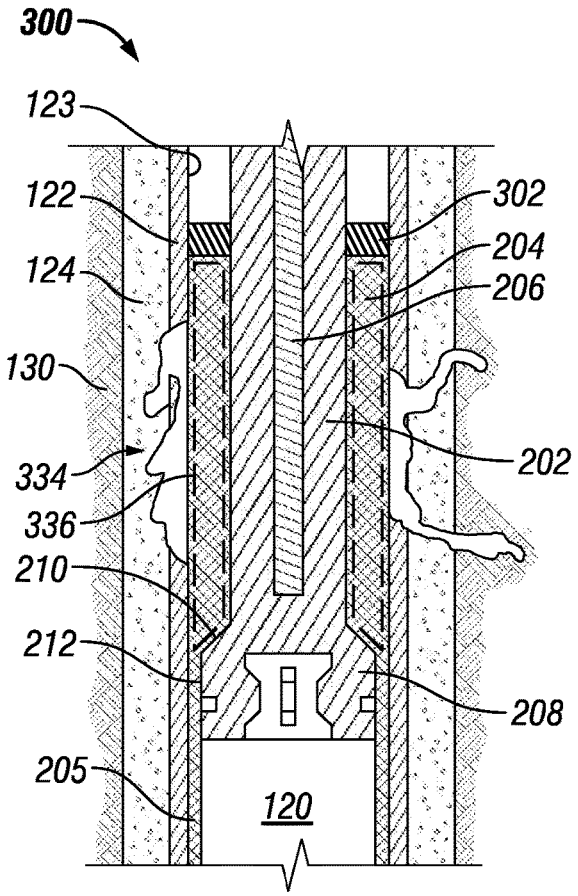
FIGS. 4 and 5 are schematic sectional views of a portion of another example implementation of the apparatus shown in FIGS. 1 and 2 at different stages of operation.
Figure 5:
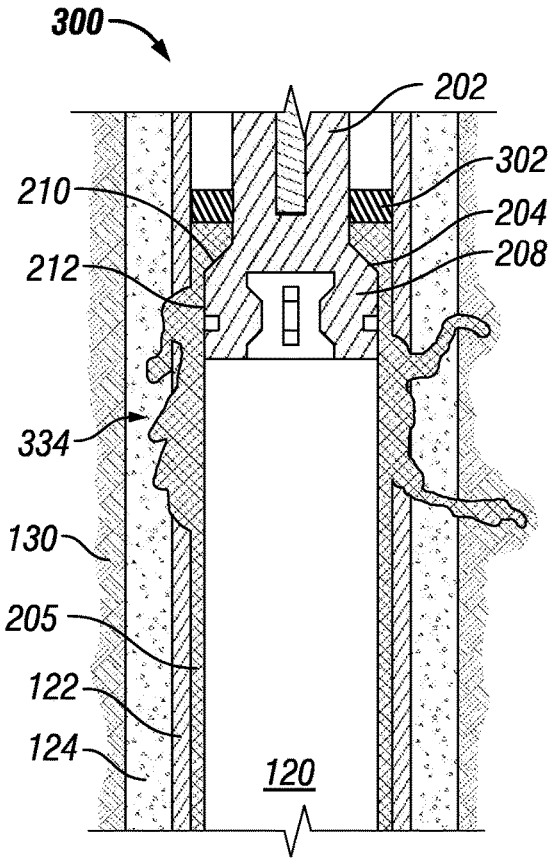

FIGS. 4 and 5 are schematic sectional views of another example implementation of the sealing tool 200 shown in FIGS. 2 and 3 according to one or more aspects of the present disclosure, and designated in FIGS. 4 and 5 by reference number 300. Unless described otherwise, the sealing tool 300 is substantially similar to the sealing tool 200 shown in FIGS. 2 and 3, including where indicated by like reference numbers. The following description refers to FIGS. 1, 4, and 5, collectively.

The sealing tool 300 is depicted in FIGS. 4 and 5 as being disposed within a portion of the wellbore 120 that does not include completion/production tubing 114, but that does include a damaged portion 334 extending into the casing 122 and perhaps the cement sheath 124 and/or the formation 130. The sealing tool 300 comprises a plug, packer, anchor, and/or other sealing member 302 that fixedly engages with the casing 122 and slidably engages with the mandrel 202 to form a fluid seal between the casing 122 and the mandrel 202. The sealing member 302 may function to constrain the melted eutectic sealing material 204 from flowing in the uphole direction beyond the sealing member 302.

In FIG. 4, the sealing tool 300 is depicted during a sealing operation stage in which the heating means 206 has melted a portion of the eutectic sealing material 204 and the mandrel 202 has been moved in the uphole direction with respect to the casing 122, thereby forming a layer 205 of eutectic sealing material on the inner surface 123 of the casing 122, as described above with respect to the layer 205 formed on the inner surface 225 of the tubular member 224 shown in FIG. 3. The remaining eutectic sealing material 204 is constrained within an annular region 336 generally defined in an axial direction by the sealing member 302 and the spreader 210 and in a radial direction by the mandrel 202 and the inner surface 123 of the casing 122. Consequently, the mandrel 202 moves in the uphole direction, the volume of the annular region 336 decreases. Accordingly, upon melting, the constrained portion of the eutectic sealing material 204 within the annular region 336 is pressurized. Such pressurization urges the melted eutectic sealing material 204 into the damaged portion 334. Thus, as shown in FIG. 5, as the mandrel 202 moves past the damaged portion 334, the damaged portion 334 may be sealed with the melted eutectic sealing material 204, including implementations in which the melted eutectic sealing material 204 flows into the damaged portion 334, and perhaps filling cracks, cavities, and/or perforations extending into the casing 122, the cement sheath 124, and/or the formation 130.

The sealing member 302 and/or another portion of the sealing tool 300 may also comprise one or more releasing features (not shown), such as collapsing dogs, shear pins, or the like. Such releasing features may be utilized for disengaging the sealing member 302 from the casing 122 to permit the tool string 110 to be retrieved to the surface.

The sealing tools 200, 300 described above may also or instead be operable to perform well abandonment operations. For example, the sealing tools 200, 300 may be deployed within the wellbore 120 and subsequently operated to fill the wellbore 120 in order to plug and abandon the wellbore 120. The sealing tools 200, 300 may also be operated as described above but allowing melted eutectic sealing material 204 to solidify around the downhole portion 208 of the mandrel 202 without removing the downhole portion 208 before such solidification, such that the downhole portion 208 and the solidified eutectic sealing material 204 collectively form a solid plug preventing communication of wellbore fluids between portions of the wellbore 120 above and below the plug. The downhole portion 208 of the mandrel 202 may then be severed from the mandrel 202, or the sealing tool 200, 300 may be disengaged from the rest of the tool string 110 and left in the wellbore 120.

Figure 6:
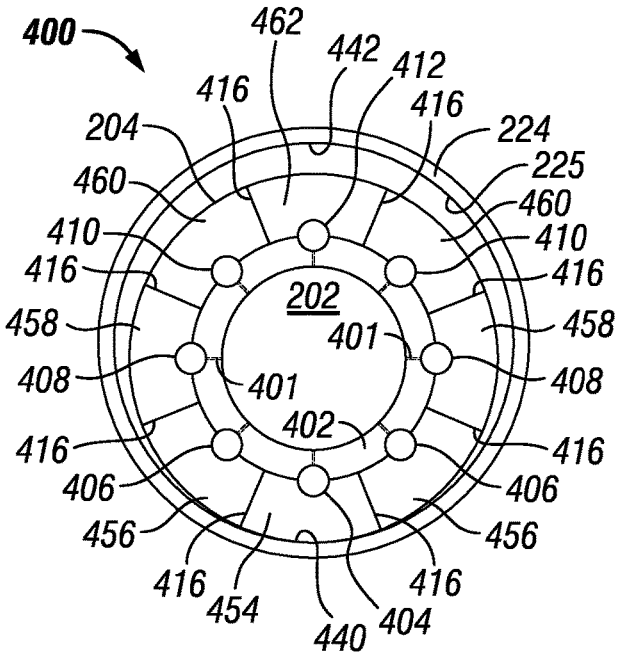
FIG. 6 is a schematic axial view of a portion of another example implementation of the apparatus shown in FIGS. 1 and 2 according to one or more aspects of the present disclosure.
Figure 7:
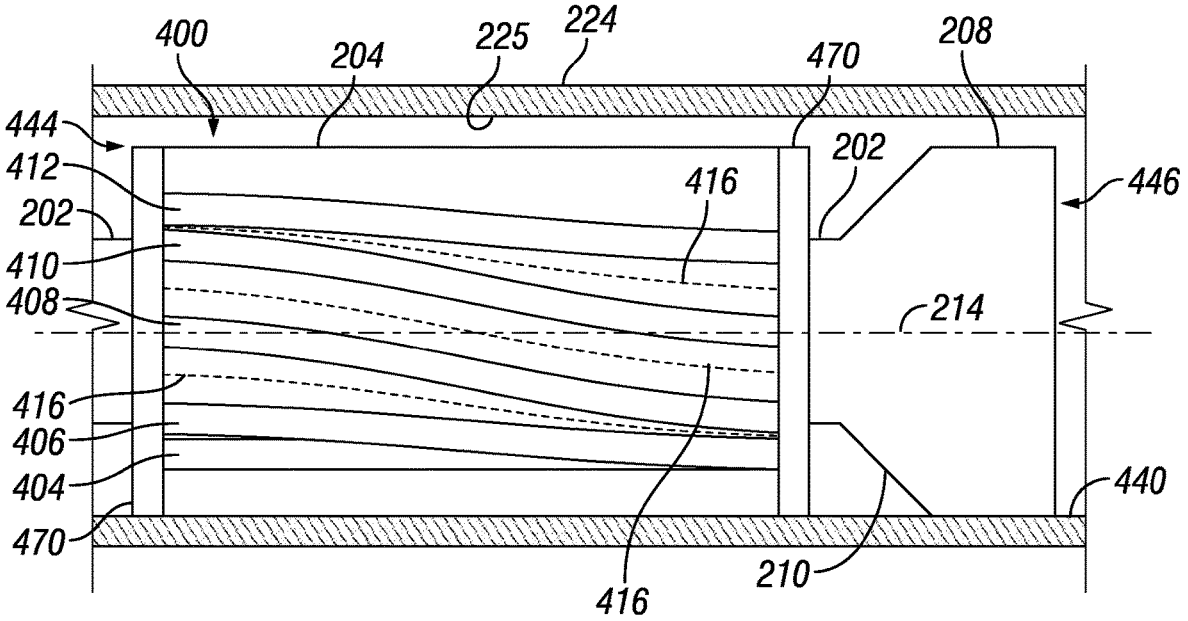
FIG. 7 is a schematic side view of the apparatus shown in FIG. 6 according to one or more aspects of the present disclosure.

FIG. 6 is a schematic top end view of another example implementation of the sealing tool 200 shown in FIGS. 2 and 3 according to one or more aspects of the present disclosure, and designated in FIG. 6 by reference number 400. Unless described otherwise, the sealing tool 400 is substantially similar to the sealing tool 200 shown in FIGS. 2 and 3, including where indicated by like reference numbers. The sealing tool 400 includes a brittle material 402 interposing the mandrel 202 and the eutectic sealing material 204, and a plurality of heating element probes 404, 406, 408, 410, 412 disposed at least partially within the eutectic sealing material 204 and/or between the eutectic sealing material 204 and the brittle material 402. FIG. 7 is a side view of the sealing tool 400 with the eutectic sealing material 204, one of the heating element probes 406, one of the heating element probes 408, and one of the heating element probes 410 removed to show an example implementation of the heating element probes 404, 406, 408, 410, 412. Although removed from view in FIG. 6 for the sake of clarity, FIG. 7 also depicts a housing 470 of the sealing tool 400. When the eutectic sealing material 204 is in its original, pre-melted form, the eutectic sealing material 204 is free from an interior portion of the housing 470, but the housing 470 axially retains the eutectic sealing material 204 around the mandrel 202. However, other means for retaining the eutectic sealing material 204 around the mandrel 202 are also within the scope of the present disclosure. (It is also noted that the sealing tools 200, 300 described above may comprise a similar housing and/or other means for retaining the pre-melted eutectic sealing material 204 around the mandrel 202). The following description refers to FIGS. 1, 6, and 7, respectively.

The sealing tool 400 may be utilized in a horizontal portion of the tubular member 224. Thus, FIGS. 6 and 7 include reference number 440 indicating the bottom (relative to the direction of gravity 401) of the inner surface 225 of the tubular member 224, and reference number 442 indicating the top of the inner surface 225 of the tubular member 224. Reference number 444 indicates the uphole end of the sealing tool 400, and reference number 446 indicates the downhole end of the sealing tool 400. It is noted, however, that the sealing tool 400 may also be utilized in vertical and other portions of the tubular member 224.

The brittle material 402 includes one or more portions collectively disposed between the mandrel 202 and the eutectic sealing material 204. For example, the brittle material 402 may be a layer formed substantially continuously around the mandrel 202 along a longitudinal length similar to the longitudinal length of the eutectic sealing material 204. The brittle material 402 may be or comprise a lattice or honeycombed steel material or the like, by which the eutectic sealing material 204 may separate from the mandrel 202 during sealing operations.

The heating element probes 404, 406, 408, 410, 412 may be utilized instead of or in addition to the heating means 206 shown in FIG. 2. The heating element probes 404, 406, 408, 410, 412 may be or comprise electrical heating coils and/or other elements operable to generate heat to melt the eutectic sealing material 204. The heating element probes 404, 406, 408, 410, 412 may be electrically energized as described above with respect to the electrical heating element implementation of the heating means 206 shown in FIG. 2, including via electrical conductors 401 (schematically depicted in FIG. 6 as dotted lines) electrically connected with one or more electrical conductors (not shown) internal to the mandrel 202. Each heating element probe 404, 406, 408, 410, 412 may be individually activated to heat and melt the eutectic sealing material 204 that is in contact with that heating element probe 404, 406, 408, 410, 412.

As shown in FIG. 7, the heating element probes 404, 406, 408, 410, 412 substantially extend along the longitudinal length of the eutectic sealing material 204. The heating element probes 404, 406, 408, 410, 412 may extend diagonally and/or helically with respect to the longitudinal axis 214 of the sealing tool 400, as depicted in FIG. 7. However, other arrangements are also within the scope of the present disclosure, such as implementations in which the heating element probes 404, 406, 408, 410, 412 extend substantially parallel or otherwise with respect to the longitudinal axis 214 of the sealing tool 400.

The eutectic sealing material 204 may be circumferentially partitioned into portions 454, 456, 458, 460, 462, such as by radially extending barriers 416. Three of the barriers 416 are schematically depicted in FIG. 7 by dashed lines, but the remaining barriers 416 are not shown (although solely for the sake of clarity). The barriers 416, and thus the portions 454, 456, 458, 460, 462 of the eutectic sealing material 204, extend diagonally, helically, parallel, or otherwise with respect to the longitudinal axis 214 of the sealing tool 400 in the same orientation as the heating element probes 404, 406, 408, 410, 412, such that each heating element probe 404, 406, 408, 410, 412 generally extends within a central region of the corresponding portion 454, 456, 458, 460, 462 of the eutectic sealing material 204. The barriers 416 may comprise the brittle material described above or another brittle material operable to withstand high temperatures generated by the heating probes 304, 306, 308, 310, 312. The barriers 316 may also comprise thin sheets of a metallic material operable to withstand the high temperatures generated by the heating probes 304, 306, 308, 310, 312 and be deformed by the spreader 210 and/or otherwise during sealing operations. The barriers 316 may also simply be gaps between the portions 454, 456, 458, 460, 462 of the eutectic sealing material 204.

When a sealing tool 200, 300, 400 within the scope of the present disclosure is utilized in a horizontal or otherwise non-vertical portion of a wellbore/tubular member, gravity may urge the melted eutectic sealing material 204 to flow in a radial or otherwise unintended direction. Accordingly, the eutectic sealing material 204 may be activated in stages and directed by the downwardly sloping barriers 416 to intended regions within the tubular member 224, such as to progressively build up or maintain the deposited eutectic sealing material 205 prior to moving the sealing tool 400 in the uphole direction. Different portions 454, 456, 458, 460, 462 of the eutectic sealing material 204 may be heated and cooled in varying series, such as to form portions of the deposited eutectic sealing material 205 on which subsequent portions 454, 456, 458, 460, 462 of the eutectic sealing material 204 may be heated and cooled, thus building an intended sealing structure portion by portion.

For example, the heating element probe 404 closest to the bottom 440 of the tubular member 224 may be activated first to melt the corresponding portion 454 of the eutectic sealing material 204. After that portion 454 of the eutectic sealing material 204 at least partially cools and sets (after deactivating the heating element probe 404), the heating element probes 406 that are next closest to the bottom 440 of the tubular member 224 (immediately above the previously utilized heating element probe 304) may be activated to melt the corresponding portions 456 of the eutectic sealing material 204. After the portions 456 at least partially set, the heating element probes 408 that are next closest to the bottom 440 of the tubular member 224 may be activated to melt the corresponding portions 458 of the eutectic sealing material 204. After the portions 458 at least partially set, the next closest heating element probes 410 may be activated to melt the corresponding portions 460 of the eutectic sealing material 204. After the portions 458 at least partially set, the uppermost heating element probe 412 may be activated to melt the corresponding portion 462 of the eutectic sealing material 204. Thus, the heating element probes 404, 406, 408, 410, 412 may be sequentially utilized such that the melted portions 454, 456, 458, 460, 462 of the eutectic sealing material 204 may each, in series, flow along the corresponding barriers 416 and onto the inner surface 225 of the tubular member 224. The sealing tool 400 may also include the spreader 210 shown in FIG. 2 and/or the sealing element 302 shown in FIG. 4, such as to aid in directing the sequentially melted portions 454, 456, 458, 460, 462 of the eutectic sealing material 204 onto progressively higher regions of the inner surface 225 of the tubular member 224, perhaps including while moving the sealing tool 400 uphole within the tubular member 224, thus progressively filling the region between about the spreader 210 and/or the downhole portion 208 of the mandrel. As successive portions of the deposited eutectic sealing material 204 cools and at least partially sets along the inner surface 225 of the tubular member, such portions block the subsequently melted other portions of the eutectic sealing material 204 from flowing in the downhole direction, thus encouraging flow up around the inner surface 225 of the tubular member 224.

After the intended portions 454, 456, 468, 460, 462 of the eutectic sealing material 204 have been melted and perhaps permitted to partially set on the inner surface 225 of the tubular member 224, whether in the serial manner described above or otherwise, the sealing tool 400 may be moved (e.g., pulled) in the uphole direction. Consequently, the spreader 210 may urge the melted or partially set eutectic sealing material 204 against the against the inner surface 225 of the tubular member 224 to shape and/or mold the eutectic sealing material 204 and, thus, patch and/or repair the tubular member 224, as described above. Such movement of the sealing tool 400 may also intentionally fracture or break the brittle material 402 and/or barriers 416 to aid in freeing the sealing tool 400 from the partially or fully set eutectic sealing material, such that the sealing tool 400 may be retrieved to the wellsite surface 105.

In view of the entirety of the present disclosure, including the figures and the claims, a person having ordinary skill in the art should readily recognize that the present disclosure introduces an apparatus comprising: a sealing tool for conveyance within a tubular member within a wellbore extending into a subterranean formation, wherein the sealing tool comprises: a mandrel; a eutectic sealing material disposed about the mandrel, wherein the eutectic sealing material has a eutectic temperature at which the eutectic sealing material melts; and means for heating the eutectic sealing material to at least the eutectic temperature.

The tubular member may be a casing member secured within the wellbore and/or a portion of completion/production tubing installed within the wellbore.

The eutectic sealing material may comprise an alloy of two or more different metals each having an individual melting temperature that is greater than the eutectic temperature. The eutectic sealing material may substantially comprise a bismuth-based alloy. The bismuth-based alloy may substantially comprise 58% bismuth and 42% tin, by weight.

The mandrel may comprise a downhole portion having a first outer diameter that may be substantially larger than a second outer diameter of the rest of the mandrel, and a surface transitioning between the first and second outer diameters may define a spreader that urges the eutectic sealing material melted by the heating means radially outward toward an inner surface of the tubular member. The spreader may be a substantially frustoconical surface extending axially tapered between the first and second outer diameters and circumferentially extending substantially continuously around the mandrel. The downhole portion of the mandrel may comprise a plurality of heat-dissipating features each extending into an outer surface of the downhole portion and/or a plurality of heat-dissipating features each extending into a cavity that extends into a downhole end of the mandrel.

The sealing tool may further comprise a sealing member operable to fixedly engage with the tubular member, slidably engage with the mandrel, and form a fluid seal between the tubular member and the mandrel.

The heating means may comprise an electrical heating coil disposed within the mandrel and/or means for activating a heat-generating chemical reaction.

The heating means may comprise a plurality of heating element probes each contacting the eutectic sealing material. The sealing tool may further comprise a brittle material securing the eutectic sealing material around the mandrel. The heating element probes may each extend along a longitudinal length of the eutectic sealing material. The heating element probes may each extend diagonally and/or helically with respect to a longitudinal axis of the sealing tool. The eutectic sealing material may be circumferentially partitioned into a plurality of portions by a corresponding plurality of barriers each extending radially and longitudinally between neighboring ones of the portions of the eutectic sealing material. The heating element probes, the portions of the eutectic sealing material, and the barriers may each extend diagonally and/or helically with respect to a longitudinal axis of the sealing tool, and each heating element probe may extend within a central region of a corresponding portion of the eutectic sealing material between neighboring ones of the barriers.

The sealing tool may be operable for conveyance within the tubular member via coiled tubing.

The present disclosure also introduces a method comprising: conveying a sealing tool within a tubular member within a wellbore extending into a subterranean formation, wherein the sealing tool comprises: a mandrel; a eutectic sealing material disposed about the mandrel, wherein the eutectic sealing material has a eutectic temperature at which the eutectic sealing material melts; and means for heating the eutectic sealing material to at least the eutectic temperature; and transferring the eutectic sealing material onto an inner surface of the tubular member by activating the heating means to heat the eutectic sealing material to at least the eutectic temperature to melt the eutectic sealing material.

Conveying the sealing tool within the tubular member may comprise conveying the sealing tool via coiled tubing.

Conveying the sealing tool within the tubular member may comprise conveying the sealing tool to a damaged portion of the tubular member, and transferring the eutectic sealing material onto the inner surface of the tubular member may comprise covering the damaged portion of the tubular member with the transferred eutectic sealing material.

Transferring the eutectic sealing material onto the inner surface of the tubular member may comprise plugging the tubular member by substantially filling a longitudinal portion of the tubular member. Substantially filling the longitudinal portion of the tubular member may comprise substantially filling the longitudinal portion with the transferred eutectic sealing material.

Transferring the eutectic sealing material onto the inner surface of the tubular member may comprise axially moving the sealing tool within the tubular member after activating the heating means but before the melted eutectic sealing material transferred onto the inner surface of the tubular member is permitted to completely solidify, such that a feature of the sealing tool may spread the melted eutectic sealing material around the inner surface of the tubular member as the sealing tool moves axially past the melted eutectic sealing material. The transferred eutectic sealing material spread around the inner surface of the tubular member may have a thickness ranging between about 5 millimeters and about 25 millimeters.

The heating means may comprise an electrical coil, and activating the heating means may comprise electrically energizing the electrical coil.

The method may further comprise, after conveying the sealing tool within the tubular member and before transferring the eutectic sealing material onto the inner surface of the tubular member, engaging a sealing member of the sealing tool with the inner surface of the tubular member to form a fluid seal between the inner surface of the tubular member and the mandrel. Transferring the eutectic sealing material onto the inner surface of the tubular member may comprise pressurizing the melted eutectic sealing material between the mandrel and the sealing member by sliding the mandrel axially through the sealing member. Pressurizing the melted eutectic sealing material may urge the melted eutectic sealing material into a damaged portion of the tubular member.

The eutectic sealing material may be circumferentially partitioned into a plurality of portions by a corresponding plurality of barriers each extending radially and longitudinally between neighboring ones of the portions of the eutectic sealing material, and the heating means may comprise a plurality of heating element probes each extending within a central region of a corresponding portion of the eutectic sealing material between neighboring ones of the barriers. Activating the heating means may comprise activating one or more of the heating element probes independently of other ones of the heating element probes. The partitioned portions of the eutectic sealing material may comprise a first partitioned portion, a second partitioned portion, and a third partitioned portion, and the plurality of heating element probes may comprise: a first heating element probe contacting the first partitioned portion but not the second and third partitioned portions; a second heating element probe contacting the second partitioned portion but not the first and third partitioned portions; and a third heating element probe contacting the third partitioned portion but not the first and second partitioned portions. Conveying the sealing tool within the tubular member may comprise conveying the sealing tool to a substantially horizontal portion of the tubular member within a substantially horizontal portion of the wellbore such that the first heating element probe is closest to a bottom side of the tubular member relative to the second and third heating element probes, and such that the third heating element probe is closest to a top side of the tubular member relative to the first and second heating element probes. Transferring the eutectic sealing material onto the inner surface of the tubular member may comprise: activating the first heating element probe, but not the second and third heating element probes, to melt the first partitioned portion, but not the second and third partitioned portions, onto the inner surface of the tubular member; then permitting the melted first partitioned portion to at least partially solidify on the inner surface of the tubular member; then activating the second heating element probe, but not the first and third heating element probes, to melt the second partitioned portion, but not the third partitioned portion, onto the at least partially solidified first partitioned portion on the inner surface of the tubular member; then permitting the melted second partitioned portion to at least partially solidify; then activating the third heating element probe, but not the first and third heating element probes, to melt the third partitioned portion onto the at least partially solidified second partitioned portion overlying the at least partially solidified first partitioned portion on the inner surface of the tubular member.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus, comprising:

a sealing tool for conveyance within a tubular member within a wellbore extending into a subterranean formation, wherein the sealing tool comprises:

a mandrel;

a eutectic sealing material disposed about the mandrel, wherein the eutectic sealing material has a eutectic temperature at which the eutectic sealing material melts, and wherein the eutectic sealing material is circumferentially partitioned into a plurality of portions by a corresponding plurality of barriers each extending radially and longitudinally between neighboring ones of the portions of the eutectic sealing material; and heating means for heating the eutectic sealing material to at least the eutectic temperature to melt the eutectic sealing material such that the eutectic sealing material flows onto an inner surface of the tubular member, wherein the heating means comprises a plurality of heating element probes each extending within a central region of a corresponding portion of the eutectic sealing material between neighboring ones of the barriers, and wherein the plurality of heating element probes are configured to be individually activated independently of other ones of the heating element probes.

2. The apparatus of claim 1 wherein the tubular member is a casing member secured within the wellbore.

3. The apparatus of claim 1 wherein the tubular member is a portion of completion/production tubing installed within the wellbore.

4. The apparatus of claim 1 wherein the eutectic sealing material comprises an alloy of two or more different metals each having an individual melting temperature that is greater than the eutectic temperature.

5. The apparatus of claim 1 wherein the eutectic sealing material comprises a bismuth-based alloy.

6. The apparatus of claim 5 wherein the bismuth-based alloy comprises a eutectic mixture of bismuth and tin.

7. The apparatus of claim 1 wherein the mandrel comprises a downhole portion having a first outer diameter that is substantially larger than a second outer diameter of the rest of the mandrel, and wherein a surface transitioning between the first and second outer diameters defines a spreader that urges the eutectic sealing material melted by the heating means radially outward toward the inner surface of the tubular member.

8. The apparatus of claim 7 wherein the spreader is a substantially frustoconical surface extending axially tapered between the first and second outer diameters and circumferentially extending continuously around the mandrel.

9. The apparatus of claim 7 wherein the downhole portion of the mandrel comprises a plurality of heat-dissipating features each extending into an outer surface of the downhole portion.

10. The apparatus of claim 7 wherein the downhole portion of the mandrel comprises a plurality of heat-dissipating features each extending into a cavity that extends into a downhole end of the mandrel.

11. The apparatus of claim 1 wherein the sealing tool further comprises a sealing member operable to fixedly engage with the tubular member, slidably engage with the mandrel, and form a fluid seal between the tubular member and the mandrel.

12. The apparatus of claim 1 wherein the sealing tool further comprises a brittle material securing the eutectic sealing material around the mandrel.

13. The apparatus of claim 1 wherein the heating element probes each extend along a longitudinal length of the eutectic sealing material.

14. The apparatus of claim 13 wherein the heating element probes each extend diagonally and/or helically with respect to a longitudinal axis of the sealing tool.

15. The apparatus of claim 1 wherein the sealing tool is operable for conveyance within the tubular member via coiled tubing.

16. The apparatus of claim 1 wherein the plurality of barriers extend radially outward further than the plurality of heating element probes.

17. A method, comprising:

conveying a sealing tool within a tubular member within a wellbore extending into a subterranean formation, wherein the sealing tool comprises:

a mandrel;

a eutectic sealing material disposed about the mandrel, wherein the eutectic sealing material has a eutectic temperature at which the eutectic sealing material melts, and wherein the eutectic sealing material is circumferentially partitioned into a plurality of portions by a corresponding plurality of barriers each extending radially and longitudinally between neighboring ones of the portions of the eutectic sealing material; and heating means for heating the eutectic sealing material to at least the eutectic temperature, wherein the heating means comprises a plurality of heating element probes each extending within a central region of a corresponding portion of the eutectic sealing material between neighboring ones of the barriers; and transferring the eutectic sealing material onto an inner surface of the tubular member by activating the heating means to heat the eutectic sealing material to at least the eutectic temperature to melt the eutectic sealing material, wherein activating the heating means comprises individually activating the plurality of heating element probes independently of other ones of the heating element probes to melt a corresponding portion of the eutectic sealing material, and permitting the corresponding portion of the eutectic sealing material to at least partially solidify on the inner surface of the tubular member.

18. The method of claim 17 wherein conveying the sealing tool within the tubular member comprises conveying the sealing tool via coiled tubing.

19. The method of claim 17 wherein conveying the sealing tool within the tubular member comprises conveying the sealing tool to a damaged portion of the tubular member, and wherein transferring the eutectic sealing material onto the inner surface of the tubular member comprises covering the damaged portion of the tubular member with the transferred eutectic sealing material.

20. The method of claim 17 wherein transferring the eutectic sealing material onto the inner surface of the tubular member comprises plugging the tubular member by substantially filling a longitudinal portion of the tubular member.

21. The method of claim 20 wherein substantially filling the longitudinal portion of the tubular member comprises substantially filling the longitudinal portion with the transferred eutectic sealing material.

22. The method of claim 17 wherein transferring the eutectic sealing material onto the inner surface of the tubular member comprises axially moving the sealing tool within the tubular member after activating the heating means but before the melted eutectic sealing material transferred onto the inner surface of the tubular member is permitted to completely solidify, such that a feature of the sealing tool spreads the melted eutectic sealing material around the inner surface of the tubular member as the sealing tool moves axially past the melted eutectic sealing material.

23. The method of claim 22 wherein the transferred eutectic sealing material spread around the inner surface of the tubular member has a thickness ranging between 5 millimeters and 25 millimeters.

24. The method of claim 17 further comprising, after conveying the sealing tool within the tubular member and before transferring the eutectic sealing material onto the inner surface of the tubular member, engaging a sealing member of the sealing tool with the inner surface of the tubular member to form a fluid seal between the inner surface of the tubular member and the mandrel.

25. The method of claim 24 wherein transferring the eutectic sealing material onto the inner surface of the tubular member comprises pressurizing the melted eutectic sealing material between the mandrel and the sealing member by sliding the mandrel axially through the sealing member.

26. The method of claim 25 wherein pressurizing the melted eutectic sealing material urges the melted eutectic sealing material into a damaged portion of the tubular member.

27. The method of claim 17 wherein:

the partitioned plurality of portions of the eutectic sealing material comprise a first partitioned portion, a second partitioned portion, and a third partitioned portion; and the plurality of heating element probes comprises:

a first heating element probe contacting the first partitioned portion but not the second and third partitioned portions;

a second heating element probe contacting the second partitioned portion but not the first and third partitioned portions; and a third heating element probe contacting the third partitioned portion but not the first and second partitioned portions.

28. The method of claim 27 wherein:

conveying the sealing tool within the tubular member comprises conveying the sealing tool to a substantially horizontal portion of the tubular member within a substantially horizontal portion of the wellbore such that:

the first heating element probe is closest to a bottom side of the tubular member relative to the second and third heating element probes; and the third heating element probe is closest to a top side of the tubular member relative to the first and second heating element probes; and transferring the eutectic sealing material onto the inner surface of the tubular member comprises:

activating the first heating element probe, but not the second and third heating element probes, to melt the first partitioned portion, but not the second and third partitioned portions, onto the inner surface of the tubular member; then permitting the melted first partitioned portion to at least partially solidify on the inner surface of the tubular member; then activating the second heating element probe, but not the first and third heating element probes, to melt the second partitioned portion, but not the third partitioned portion, onto the at least partially solidified first partitioned portion on the inner surface of the tubular member; then permitting the melted second partitioned portion to at least partially solidify; and then activating the third heating element probe, but not the first and third heating element probes, to melt the third partitioned portion onto the at least partially solidified second partitioned portion overlying the at least partially solidified first partitioned portion on the inner surface of the tubular member.

29. The method of claim 17 wherein the plurality of barriers extend radially outward further than the plurality of heating element probes.

* * * * *